United States Patent [19]

Argazzi

[11] Patent Number: 4,621,485

[45] Date of Patent: Nov. 11, 1986

[54] APPARATUS FOR PROCESSING AND SUPPLYING CONTAINERS OF BOXES TO THE OUTLET OF TUBE-FILLING MACHINES, PARTICULARLY FOR USE WITH TUBE-FILLING AND BOXING MACHINES

[75] Inventor: Ivo Argazzi, Pianoro Nuova, Italy

[73] Assignee: I.M.A. - Industria Macchine Automatiche S.p.A., Ozzano Emilia, Italy

[21] Appl. No.: 749,878

[22] Filed: Jun. 27, 1985

[30] Foreign Application Priority Data

Jul. 18, 1984 [IT] Italy ..... 3530 A/84

[51] Int. Cl.[4] ..... B65B 43/30

[52] U.S. Cl. ..... 53/564; 493/317

[58] Field of Search ..... 53/564, 458; 493/318, 493/317, 316, 313

[56] References Cited

U.S. PATENT DOCUMENTS 2,760,415 8/1956 Hornsteiner ..... 493/317 X
3,156,167 11/1964 Galloway ..... 493/317
3,443,487 5/1969 Knight ..... 493/317
3,566,762 3/1971 Vadas et al. ..... 493/317 X
3,592,003 7/1971 Stichhan ..... 53/373 X

*Primary Examiner*—James F. Coan
*Attorney, Agent, or Firm*—Karl F. Ross; Herbert Dubno

[57] ABSTRACT

An apparatus for processing and supplying containers or boxes to the outlet of the processing line of the tube-filling machine section and to the inlet of the boxing machine section of the tube-filling and boxing machine type, has a forked body having substantially coplanar prongs supported in an inclined and freely rotatable manner in the region of its shank. A kinematic articulated lever linkage is associated with a respective prong of the forked portion of this body supported freely and in an inclined manner. A suction device is controlled by the respective kinematic articulated lever linkage. The unit is equipped for the simultaneous control of the respective kinematic articulated lever linkages. An actuator actuates the forked body in an oscillating manner in both directions, and another actuator effects the simultaneous control of the kinematic articulated lever linkages.

2 Claims, 6 Drawing Figures

APPARATUS FOR PROCESSING AND SUPPLYING CONTAINERS OF BOXES TO THE OUTLET OF TUBE-FILLING MACHINES, PARTICULARLY FOR USE WITH TUBE-FILLING AND BOXING MACHINES

CROSS REFERENCE TO RELATED APPLICATIONS

This application is related to the commonly owned concurrently filed copending applications Ser. No. 749,876 and Ser. No. 749,879.

FIELD OF THE INVENTION

The present invention relates to apparatus for processing and supplying containers or boxes to the outlet of tube-filling machines particularly for use with tube-filling and boxing machines.

The invention relates more precisely to apparatus which is particularly designed to process and supply containers or boxes to the outlet of the processsing line of the tube-filling machine section and to the inlet of the boxing machine section of the tube-filling and boxing machine type as disclosed in one of the above-mentioned applications which relates to a method for processing and packaging preformed crushable tubular containers having an open base in boxes and a tube-filling and boxing machine for the automation of this method.

BACKGROUND OF THE INVENTION

This method and this tube-filling and boxing machine take from a supply hopper, the horizontally disposed preformed tubes with open bases to be processed in individual succession and in a positive manner, supply them in a free falling manner and despatch them, still in a positive manner, i.e. so that they are controlled, to a member designed to insert them positively in a vertical arrangement with their open bases facing upwardly into resiliently take-up members of the processing line of the tube-filling machine along which the tubes are moved in successive steps.

The tubes are filled and have their bases, which form the actual base, sealed in a conventional manner. The tubes processed in this way, i.e. filled and with their bases sealed, are taken up rhythmically, still in phase with the successive step feed along the processing line of the tube-filling machine, by transfer members designed to insert them in respective prefabricated packaging boxes or containers having their filling apertures upwardly open, which members are displaced, still in a positive manner, in an identical rhythmic succession to a boxing station and are closed at this station inside the corresponding boxes with the subsequent closure of the filling apertures of the boxes.

In the context of the boxing of the tubes in individual succession at the outlet of the processing line of the tube-filling machine section and at the inlet of the boxing machine section as set out in this application, it is necessary to process and supply boxes by taking the relative blanks disposed with the container faces of these boxes folded flat and superimposed in mutual contact from the supply hopper.

SUMMARY OF THE INVENTION

This is accomplished according to the invention with a forked body having substantially coplanar prongs which is supported in an inclined and freely rotatable manner in the region of its shank, kinematic articulated lever means associated with a respective prong of the forked portion of this body supported in an inclined and freely rotatable manner, suction means controlled by the respective kinematic articulated lever means, means for the simultaneous control of these kinematic articulated lever means, means for actuating the forked body in an oscillating manner in both directions, and means designed to actuate the simultaneous control means for the kinematic articulated lever means.

The apparatus of the present invention for processing and supplying containers or boxes to the outlet of the processing line of a tube-filling machine section and to the input of a boxing machine section of the tube-filling and boxing machine type comprises a hopper (store) disposed horizontally and designed to receive and contain stacks of tubular blanks folded flat with their respective faces or panels superimposed in mutual contact. A rod disposed to slide coaxially in the freely forked rotating body with its corresponding opposite ends between the prongs of the forked portion thereof and respectively externally to the shank portion of the freely rotating body.

Each of a pair of suction means, a pair of the kinematic articulated lever means, is associated in an articulated and mirror-like manner with a respective prong of the forked portion of the freely rotating body. The kinematic articulated lever means of each pair comprises a pair of multiple-arm levers with the end of a first arm of this pair of multiple-arm levers articulated on a corresponding suction means and the end of a second arm linked to the said rod between the prongs of the forked portion. The actuation means is designed to actuate the forked body in a mirror-symmetrical oscillating manner in both directions and further actuation means is designed to actuate, in an alternating manner, the slideable rod which is linked to the end of the second arm of the pair of multiple-arm levers of the pair of kinematic articulated lever means so as to expand and contract the pair of suction means with respect to the forked portion at every oscillation of the oscillating body in an opposite direction.

BRIEF DESCRIPTION OF THE DRAWING

Further features and advantages of the apparatus of the invention will be illustrated in detail in the following description of a preferred practical embodiment thereof, given purely by way of non-limiting example with reference to the accompanying drawing, in which.

SPECIFIC DESCRIPTION

Figure 1:
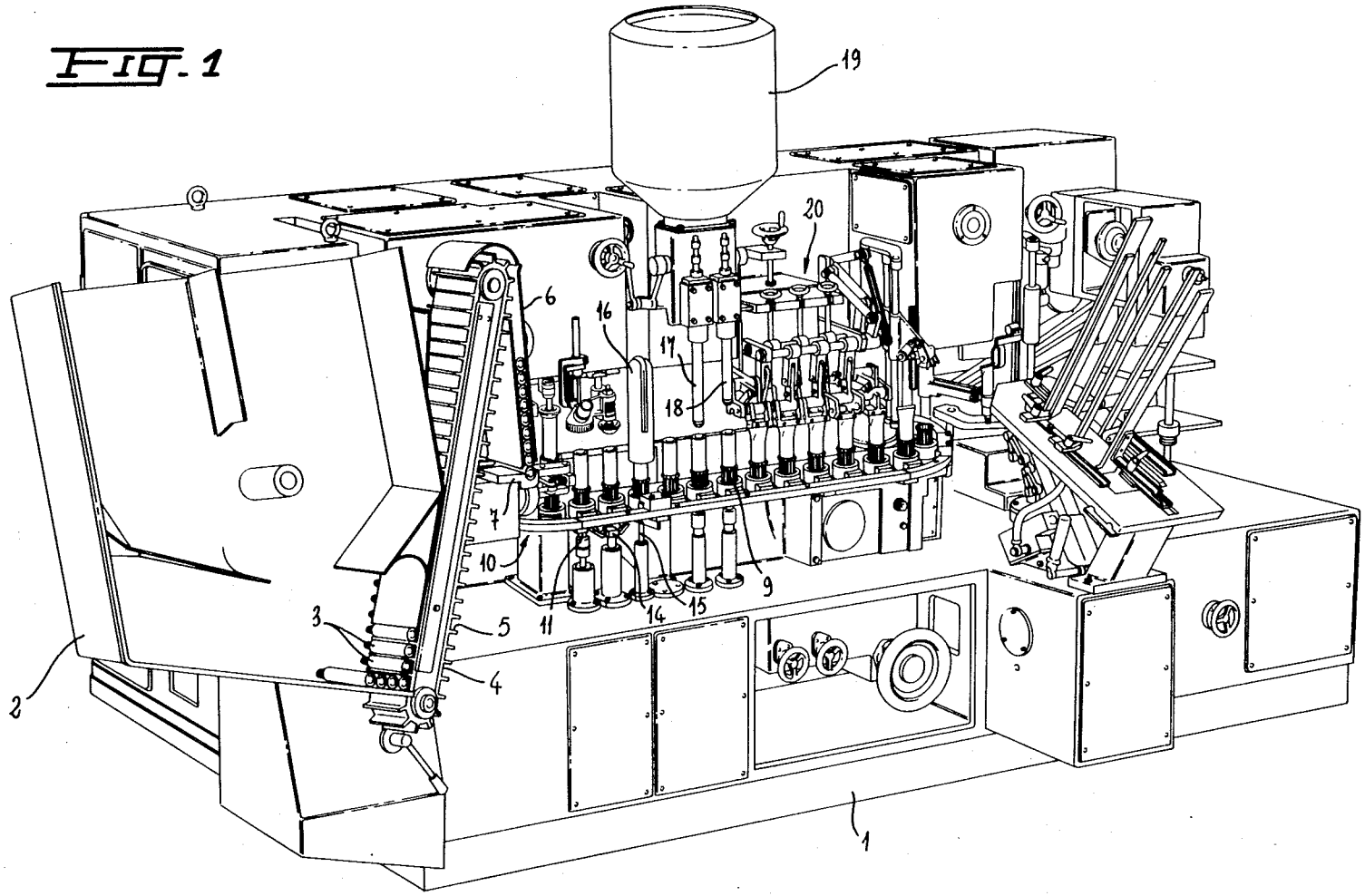
FIG. 1 is a partial front perspective view of the machine described in the above-mentioned applications.

With reference to FIG. 1 which, as mentioned, shows an example of a possible practical embodiment of the tube-filling and boxing machine for the automation of this method in accordance with the above-mentioned applications, it can be seen that this comprises an elongate base 1 which supports at one end (the left-hand end of FIG. 1), a container hopper 2 in which preformed tubes 3 having open bases are horizontally disposed.

The hopper 2 has its base inclined towards the inner portion of the machine and its right-hand container wall in FIG. 1, i.e. still towards the interior of the machine, is partially bounded, and more precisely in the lower area towards the said base, by an endless conveyor 4 of the type having take-up sections 5 for successive individual tubes 3. This sectional conveyor 5 is disposed in an upwardly inclined manner towards the interior of the machine and terminates at the top at the location of a slide duct 6 into which the tubes 3 taken up horizontally by the conveyor 4 with sections 5 from the interior of the hopper 2 with an inclined base, are discharged.

This slide duct 6 is inclined in a mirror-symmetrical manner with respect to the sectional conveyor 4-5 and terminates at its base at the location of a rocker transfer member 7 for the tubes 3 which are supplied thereto in individual sequence from the slide duct 6. This rocker transfer member 7 is provided with a horizontal reciprocating movement and may therefore transfer the tubes 3 in individual sequence and in a positive manner to a gripper element 8.

This gripper element 8, in addition to the synchronized opening and closing movement of the jaws of the gripper for the purposes of gripping the horizontally disposed tubes 3 in the rocker of the transfer member 7, is also caused to oscillate in a rotary manner about a horizontal axis so as to be able to insert, still in individual sequence, the vertically disposed tubes 3 having their bases upwardly open, into resilient take-up means 9 associated with endless conveyor means 10 in a horizontal plane, provided with a stepped movement and forming the processing line of the tube-filling section of the machine.

The vertically disposed tubes with their bases upwardly open are displaced along this processing line so that they pause at successive operating stations such as, for example, a station for checking the presence of a closure stopper at the bottom end of the erect tube and for tightening the latter with the means 11, for cleaning of the tube using a blowing and suction device 12, for centering the print using movable upper contrast means 13 and rotary gripper means 14, and for the ejection of defective tubes by means of ejector means 15 via a reverse discharge duct 16 of the machine. The tubes are then moved further along the processing line and caused to pause at stations for filling in two successive stages via the corresponding upwardly open base using means 17 and 18 associated with a container 19 for the paste product, and for the sealed closure of this base by means, for example, of filling means, shown in their entirety by 20, for the end zone by flattening this zone of the tubes themselves thereby forming their bases.

At this point gripper means 21 are designed to take the closed and sealed tubes from this processing line and to transfer them into a respective box having its filling aperture upwardly open. In the specific case shown in FIG. 1 of the attached drawings, the boxes are erected with their filling apertures open by taking blanks from a blank store 22. After the simultaneous supply and insertion of leaflets containing instructions for the use of the product into the boxes, these boxes are supplied to the box closure line of the boxing section of the machine, along which the closure of the said filling aperture is carried out.

As mentioned above, the present invention relates to apparatus for processing and supplying containers or boxes to the outlet of the processing line of the tube-filling machine section and to the inlet of the boxing machine section of the tube-filling and boxing machine type described briefly above, by taking tubular blanks S (see FIG. 3) folded flat with their respective faces or panels superimposed in mutual contact from the hopper (store) 22 disposed in an inclined manner and designed to receive and contain stacks of these blanks S.

Figure 2:
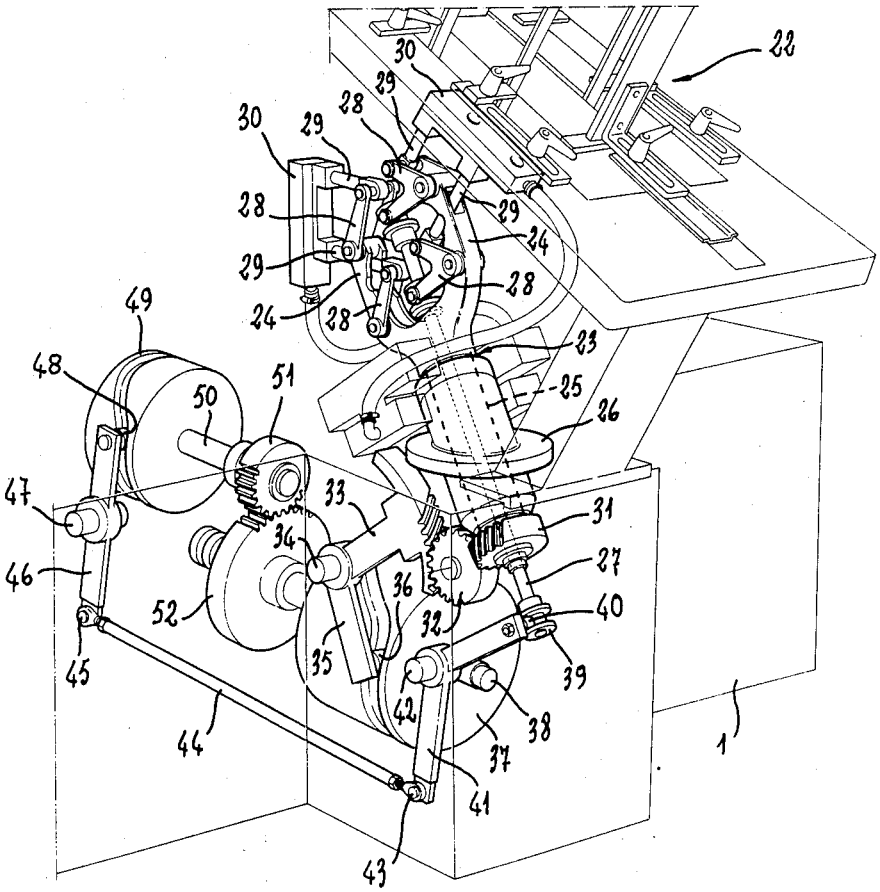
FIG. 2 is a perspective view of the apparatus of the invention, designed particularly for use with the type of machine shown in FIG. 1.
Figure 3:
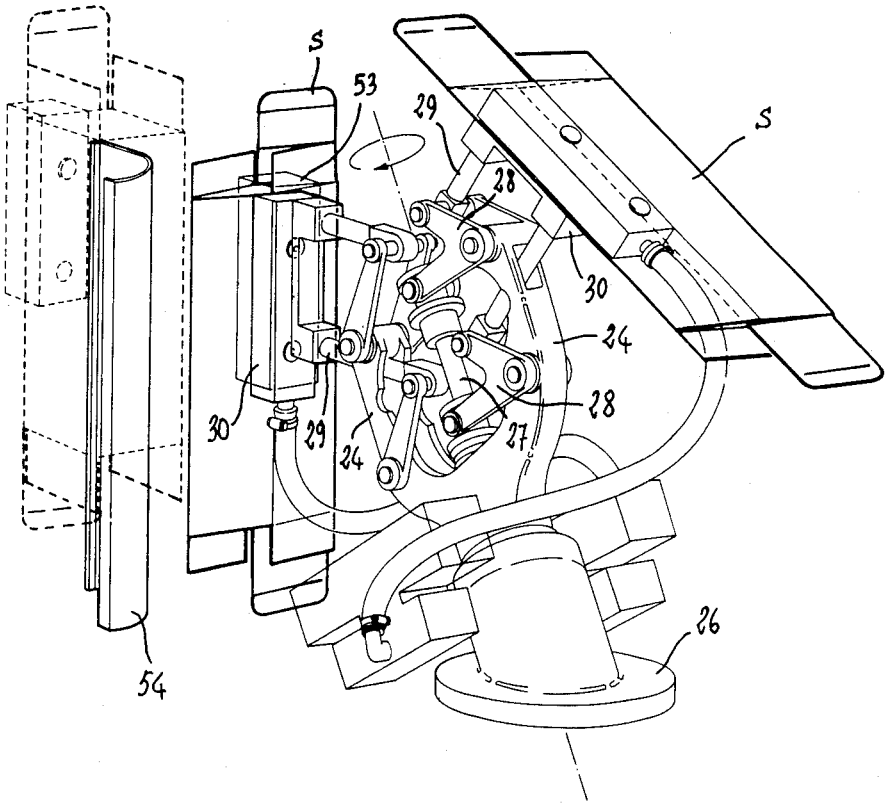
FIG. 3 shows the apparatus of FIG. 2, on a slightly enlarged scale, during one stage of operation.

This apparatus, shown in detail in FIGS. 2 and 3, is formed, according to the present invention, by a body 23 formed as a fork with substantially coplanar prongs 24 and supported in an inclined and freely rotatable manner in the region of its shank portion 25 by a support body 26 borne by the base 1 of the machine and is disposed substantially below the inclined hopper 22. A tappet rod 27 is disposed in a coaxially slidable manner in the said freely rotatable body 23 with its corresponding opposite ends between the prongs 24 of the said forked portion and respectively externally to the shank portion 25 of the freely rotatable body 23 (see FIG. 2).

Each of the said prongs 24 supports in an articulated and mirror-like manner a corresponding pair of multiple-arm levers 28, with the end of one of the arms of each pair articulated on rods 29 rigid with a respective suction means 30 and the end of a second arm articulated in a linked manner, and in a mirror-like way (see FIG. 3) to the said rod 27 between the prongs 24 of the forked portion of the body 23. In accordance with the present invention, the freely rotatable body 23 is actuated such that it oscillates in a mirror-like fashion in both directions, whilst the tappet rod 27 is actuated with an alternating movement. In effect, the lower end of the shank portion 25 of the freely rotatable body 23 projects from the support body 26 (see FIG. 2), and there is fixed to this end a gearwheel 31 which meshes with a free gearwheel 32 which in turn meshes with a toothed gear 33. This toothed gear 33 is mounted to oscillate about a pin with a horizontal axis 34 and is provided with an arm 35 at the free end of which it supports an idler roller 36 engaged in the throat of a cylindrical cam 37 keyed on a horizontal shaft 38 driven by the transmission and control mechanism of the machine (not shown).

As regards, however, the alternating movement of the tappet rod 27, the latter is provided for this purpose at its lower free end with a grooved ring 39 in whose groove there is engaged an idler roller 40 supported at the free end of one of the arms of a two-armed lever 41 mounted to oscillate about a pin with a horizontal axis 42. The free end of the other arm of this two-armed lever 41 is articulated at 43 on one end of a tie rod 44 whose other end is articulated at 45 on the free end of a two-armed lever 46 mounted to oscillate about a horizontal axis 47. The free end of the other arm of this latter two-armed lever 46 supports an idler roller 48 engaged in the throat of a second cylindrical cam 49 keyed on a shaft 50 on which there is also keyed a gearwheel 51 in engagement with a gearwheel 52 keyed in turn on the motor-driven shaft 38.

The supply of the blanks S in individual sequence takes place by suction, using a suction means 30 (for example the means on the right-hand side of FIG. 3), of one of the blanks from below the hopper 22 and by the rotation through 180° in one of the two possible directions of the forked body 23 with prongs 24, this blank then being brought into the left-hand position with the subsequent displacement of the other suction means 30 from left to right for the purposes of taking up a further blank.

At the beginning and end of this rotation through 180°, the suction means 30, by means of the alternating movement of the tappet rod 27, are moved away from and brought towards the forked portion with prongs 24 by the levers 28, thereby facilitating the removal of the blank from the base of the hopper 22.

Figure 4:
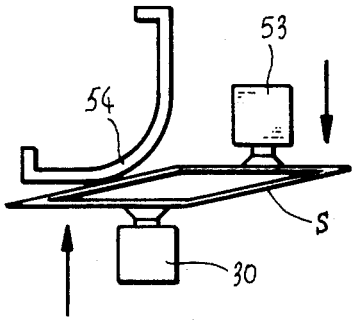
FIGS. 4, 5 and 6 show further stages of operation relating to the opening or processing of the boxes
Figure 5:
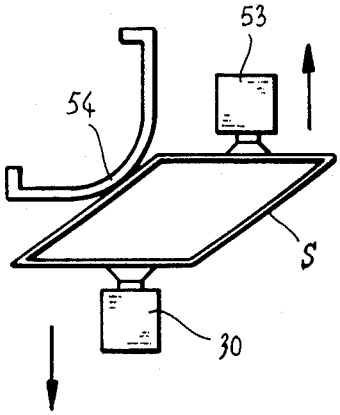
Figure 6:
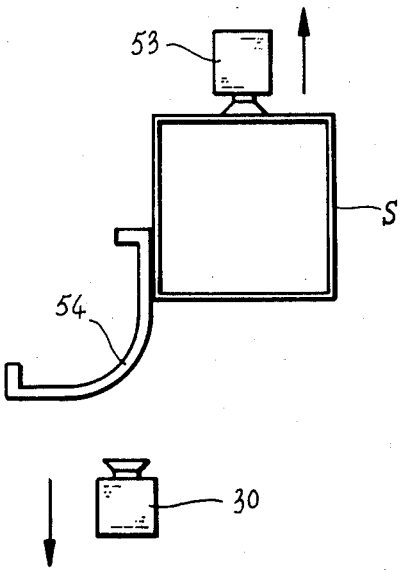

From the left-hand position, the blank S is taken up by a further suction means 53 (at the location of the opposite face but offset with respect to the face of the take-up means 30, see FIGS. 4, 5 and 6 in particular) and brought by this means into contact with the deflector 54 so as to take it up by suction (so-called rectifying operation) before causing it to move to the inlet of the boxing machine section to receive the closed and sealed tube from the outlet of the tube-filling machine.

The description of the apparatus given with reference to the attached Figures is obviously only given by way of example and it is evident that any modifications and variants suggested by practice or by its use, on the basis of and within the scope of the following claims, may be made thereto.

I claim:

1. In a tube-filling and boxing machine of the type comprising a hopper containing horizontally disposed preformed crushable tubes with open bases, positively acting means designed to take up these tubes having open bases in individual sequence so as to supply them in a similar individual sequence to positive gripper means for transfer to further gripper means for orientating and transferring these tubes with their bases upwardly open and disposed vertically to resilient take-up means associated with endless conveyor means in a horizontal plane with a successive step movement forming a processing line along which the said tubes are checked, filled and sealed at their base by flattening and crushing of their base zone, means designed to take up blanks and simultaneously to form packaging boxes with filling apertures upwardly open, additional gripper means designed to take up the closed and sealed tubes by taking them up at the location of the flattened base from the processing line and to transfer them into a respective box through its filling aperture, means designed to close the filling apertures of the boxes, and an apparatus for processing and supplying the boxes to a boxing machine section of the tube-filling and boxing machine, the improvement wherein said apparatus comprises a forked body having substantially coplanar prongs supported in an inclined and freely rotatable manner at a location of a shank of the forked body, kinematic articulated lever means associated with a respective prong of the forked portion of this body supported in an inclined and freely rotatable manner, suction means controlled by the kinematic articulated lever means, means for the simultaneous control of the said kinematic articulated lever means, first actuation means for actuating the forked body in an oscillating manner in both directions and second actuation means for actuating the means for the simultaneous control of the kinematic articulated lever means.

2. The improvement defined in claim 1 wherein a rod is disposed in a coaxially slideable manner in said freely rotatable body with corresponding opposite ends between the prongs of the said forked body and respectively externally of the shank portion of the freely rotatable body, a pair of such suction means being provided, a pair of such kinematic articulated lever means being provided, each of which is associated in an articulated and mirror-symmetrical manner with a respective prong of the forked portion of the freely rotatable body, each pair of kinematic articulated lever means comprising a pair of multiple-arm levers with the end of a first arm of each pair of these multiple-arm levers articulated on a corresponding suction means and the end of a second arm linked to the said rod between the prongs of the forked portion, actuation means designed to actuate the said forked body so that it oscillates in a mirror-symmetrical manner in both directions, said second actuation means being constructed and arranged to move with an alternating movement said slidable rod which is linked with the end of the second arm of the pair of multiple-arm levers of the pair of kinematic articulated lever means so as to extend and contract the said pair of suction means with respect to the forked portion during every oscillation of the oscillating body in the opposite direction.

* * * * *